US005910163A

United States Patent [19]

Schlamp

[11] Patent Number: 5,910,163

[45] Date of Patent: Jun. 8, 1999

[54] REFRIGERATOR WITH SEVERAL LOCKABLE COMPARTMENTS

[75] Inventor: Hans Schlamp, Munich, Germany

[73] Assignee: Accumulata Verwaltungsgesellschaft mbH, Munich, Germany

[21] Appl. No.: 08/936,746

[22] Filed: Sep. 25, 1997

[30] Foreign Application Priority Data

Sep. 26, 1996 [DE] Germany ..... 196 39 696

[51] Int. Cl.[6] ..... F25D 3/04

[52] U.S. Cl. ..... 62/256; 62/408; 62/186; 62/187; 62/298; 62/407

[58] Field of Search ..... 62/408, 186, 187, 62/256

[56] References Cited

U.S. PATENT DOCUMENTS

| | | | |
|---|---|---|---|
| 3,477,243 | 11/1969 | Schroeder | 62/298 |
| 4,741,167 | 5/1988 | Wigley | 62/62 |
| 5,758,512 | 6/1998 | Peterson et al. | 62/407 |

FOREIGN PATENT DOCUMENTS

| | | |
|---|---|---|
| 610 118 | 2/1935 | Germany . |
| 19 39 657 | 1/1966 | Germany . |
| 70 15 010 | 4/1970 | Germany . |
| 39 14 686 | 3/1991 | Germany . |
| 93 02 069 | 8/1993 | Germany . |

*Primary Examiner*—Henry Bennett
*Assistant Examiner*—Mal Shulman
*Attorney, Agent, or Firm*—Jacobson, Price, Holman & Stern, PLLC

[57] ABSTRACT

The invention relates to a refrigerator with several cooling compartments (1 to 12), each of which can be closed by a flap (1' to 12'). When a door (30) is manipulated into its closed position, the flaps (1' to 12') are moved into their closed state by the door (30).

17 Claims, 2 Drawing Sheets

REFRIGERATOR WITH SEVERAL LOCKABLE COMPARTMENTS

The invention relates to a refrigerator with several lockable compartments according to the preamble of the patent claim 1.

There exist refrigerators, which exhibit a series of compartments that are partially cooled and each of which can be locked with a latch able door or flap and which serve to store goods, in particular from the food sector.

The flaps of the lock boxes can be locked or unlocked by means of computer control. For example, such a refrigerator is described in the DE 39 14 686 C2. Each flap of the cooled compartments has to be insulated so that the cooling may be justified from an economic view point and the cooling losses are avoided as much as possible. In the prior art apparatus each flap must exhibit a hydraulic door locking mechanism, a magnetic seal and expensive hinges.

The object of the present invention is to provide a refrigerator, which has several compartments and whose design is significantly simpler.

This problem is solved by a refrigerator with the features of patent claim 1.

The important advantage lies in the fact that the refrigerator according to the invention can be designed comparatively simply and, therefore, inexpensively. Stated precisely, the individual flaps of the cooled compartments in the present invention exhibit neither insulation nor seals. Own hydraulic locking mechanisms are not mandatory. At the same time it is guaranteed that the individual lock boxes can be operated quickly and simply.

The invention and its embodiments are explained in detail with reference to the figures in the following.

Figure 1:
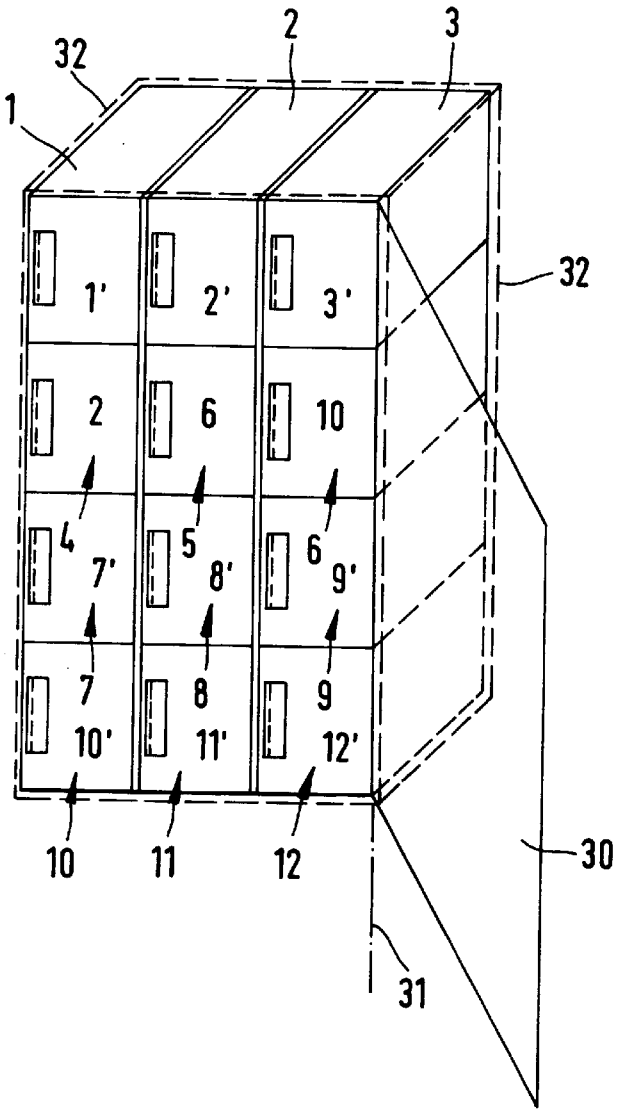
FIG. 1 is a graphic representation of an embodiment of the refrigerator according to the invention.

As evident from FIG. 1, the refrigerator under consideration exhibits several cooling compartments 1 to 12, which are arranged side-by-side and/or stacked one above the other. In the example of FIG. 1, the twelve cooling compartments 1 to 12 are designed as squares. The access flaps of the cooling compartments 1 to 12 are marked 1' to 12'. The cooling compartments 1 to 12 are combined into one unit preferably in a frame or housing 32 that is shown graphically.

The cooling compartments 1 to 12 have a common door 30, which is attached in such a manner to the unit comprising the cooling compartments 1 to 12, for example, to the said housing 32, that in the closed state said door overlaps at least partially all of the flaps 1' to 12' of the cooling compartments 1 to 12 and also holds in the closed state. Furthermore, it is important that, when the door 30 is being closed, the flaps 1' to 12' of the cooling compartments 1 to 12 are automatically pushed into their respective closed state by means of the door 30. There is a sealing mechanism, preferably a magnetic seal 50, which makes sure that the space enclosed by the door 30 and the frame 32 is sealed when the door 30 is closed, so that the cooling compartments 1 to 12 located in this space can be cooled by one unit.

The door 30 can be held in the closed position, for example, by means of a mechanical snap mechanism at the housing 32.

Figure 2:
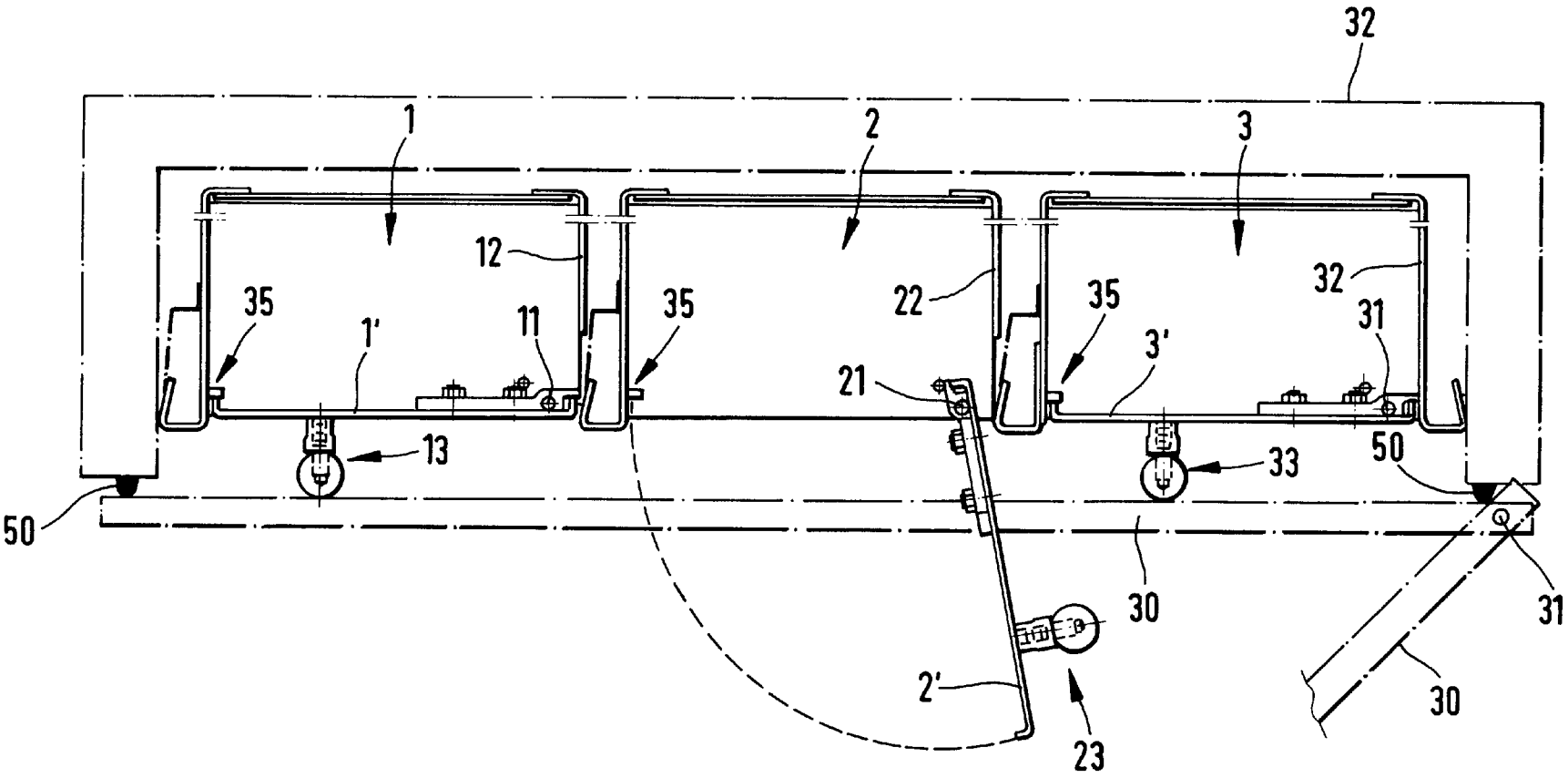

FIG. 2 depicts a preferred embodiment of the refrigerator under discussion; it is a horizontal cross sectional view of the top three cooling compartments 1 to 3 of FIG. 1. Thus the flaps 1' and 3' are shown in the closed state; and flap 2' in the open state. Each flap 1' to 3' can be swivelled around a point of rotation 11, 21 or 31 relative to its housing 12, 22 or 32. The door 30, which operates collectively the flaps 1' to 12' of the lock boxes 1 to 12, which are combined into one unit, can be swivelled around a point of rotation 31 preferably relative to the housing 32 accommodating the lock boxes 1 to 12. However, it must be pointed out that the door 30 can also be designed so as to swivel differently, for example, at a recess in the wall or the like, where the recess of the wall forms the housing 32.

To operate all of the flaps 1' to 12' collectively in the closed state when the door 30 is being closed, the flaps 1' to 12' are designed in such a manner that they are rotated out of the open state (flap 2') by the self-closing door 30 around their point of rotation 21 in the direction of the closed state and are moved automatically into the closed state (flaps 1' and 3') by means of an actuating device 13, 23, 33, which acts between the door 30 and the flaps 1' to 12' whenever the door 30 is completely closed, in that they are latched preferably by a locking mechanism, which shall be explained in detail below.

Preferably the individual flaps 1' to 3' are moved forward by means of known spring hinges into the closed position. Preferably the door 30 exhibits a hydraulic locking mechanism, which moves it automatically, after its release, into the closed position.

In this respect it is important that this unique locking mechanism supplies the necessary closing force for all of the flaps 1' to 3' under discussion.

Figure 3:
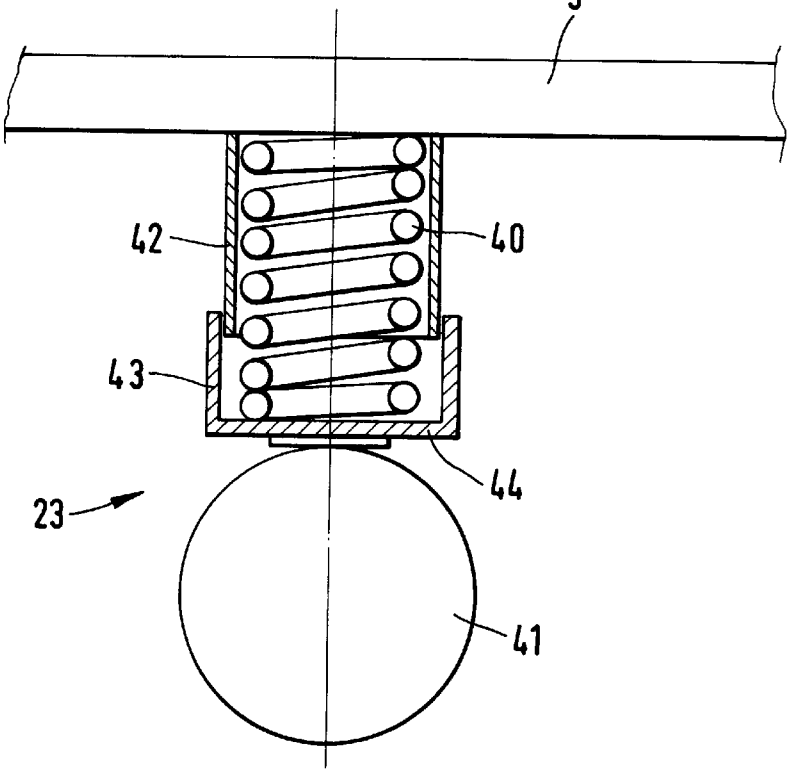
FIG. 2 is a cross sectional view of the refrigerator under consideration and FIG. 3 depicts a preferred embodiment of the invention.

According to FIG. 3, the actuating device 13 to 33 exists in order to balance the tolerances and to reach a uniform closing force on all of the flaps 1'2'3' preferably from a buffer or energy storage 40, which exhibits preferably the form of a spiral spring, which is braced, on the one hand, against the flap 1', 2', 3' and against whose other end an actuating element 41 can be forced by means of the door 30 in the direction of the flap 1', 2', 3' under compression of the spring 40. Preferably a spherical head 41 serves as the actuating element; said spherical head also serves simultaneously as a handle for the flap 1', 2', 3'. The helical spring 40 is installed into interlocking pipe segments 42, 43, which can be slid against or with the force of the helical spring 40, whereby one pipe segment 42 is attached to the flap 1', 2', 3' and whereby the spherical head 41 is attached externally to the other pipe segment 43, preferably to a front wall 44 terminating the pipe segment 43. A stop, which is not shown in detail, provides that the pipe segments 42, 43 cannot detach from one another. When the door 30 is being closed, the inside of the same strikes the spherical heads 41, so that they are forced against the force of the springs 40 to the flaps 1', 2', 3' (FIG. 2), the high closing force that is necessary for closing the flaps is produced, and the graphically shown locking mechanism 15, 25 or 35 is actuated. The locking mechanism 15, 25, 35 is designed preferably in such a manner that in the closed state the respective flap 1', 2', 3' snaps into a snap-in mechanism, which can be operated electromagnetically in order to enable the opening of the flap 1', 2', 3' after the door 30 has been opened.

The flaps 1' to 12' are prestressed in the well-known manner by the aforementioned spring elements, which are mounted preferably on the axles 11, 21, 31, in the direction of the closing positions, so that after they have been released they can be swivelled automatically in the direction of the closed state.

The described actuating devices 13, 23, 33 can also be designed in such a manner that they are attached to the door 30 and that their spherical heads 41 are forced against the corresponding flaps 1', 2', 3'. Other actuating devices, e.g. in the form of elastically compressible material parts, are also conceivable.

The door 30 is made preferably of an insulating glass material so that the flaps 1' to 12' are visible from the outside. In general the door 30 and the housing 32 are made of insulating materials, which hold the cold air in the space enclosed by them.

I claim:

1. Refrigerator with several cooling compartments (1 to 12), each of which can be closed with a flap (1' to 12'), characterized by a door (30), which, when manipulated into its closed position, the flaps (1' to 12') are moved into their closed position by means of the door (30).

2. Refrigerator, as claimed in claim 1, characterized in that the cooling compartments (1 to 12) are arranged in a housing (32), where the door (30) is mounted so as to pivot around its own axis (31).

3. Refrigerator, as claimed in claim 2, characterized by a sealing mechanism (50), which makes sure that the space enclosed by the door (30) and the housing (32) is sealed when the door (30) is in the closed position.

4. Refrigerator, as claimed in claim 3, characterized in that the sealing mechanism (50) is a magnetic seal.

5. Refrigerator, as claimed in claim 1, characterized in that each flap (1' to 12') exhibits a locking mechanism (35), by means of which they can be held in the closed state.

6. Refrigerator, as claimed in claim 5, characterized in that the locking mechanism (35) exhibits a snap-in mechanism, which locks said flap (1' to 12') in the closed state and which can be actuated electromagneticly for opening the flap (1' to 12').

7. Refrigerator, as claimed in claim 1, characterized in that each flap (1' to 12') has an actuating device (13), which exhibits an energy store (40), which becomes effective between the door (30) and the flap (1' to 12') when the door (30) is closed and produces a force that pushes the flap (1' to 12') into the closed state.

8. Refrigerator, as claimed in claim 7, characterized in that the energy store exhibits the form of a spring, whose one end is braced against the flap (1' to 12') and whose other end has an actuating element (41), against which the inside of the door (30) is pushed when said door is closed.

9. Refrigerator, as claimed in claim 7, characterized in that the energy store exhibits the shape of a spring, whose one end is braced against the door (30) and whose other end has an actuating element (41), which is pushed against the flap (1' to 12') when the door (30) is closed.

10. Refrigerator, as claimed in claim 8, characterized in that the spring (40) is a helical spring, mounted in pipe segments (42, 43), which can be moved axially head-on, whereby one pipe segment is attached to the flap (1' to 12') and whereby the actuating element is attached to the other pipe segment (43).

11. Refrigerator, as claimed in claim 9, characterized in that the spring (40) is a helical spring, mounted in pipe segments (42, 43), which can be moved axially head-on, whereby one pipe segment is attached to the door (1' to 12') and whereby the actuating element is attached to the other pipe segment (43).

12. Refrigerator, as claimed in claims 8, characterized in that the actuating element exhibits the shape of a ball.

13. Actuating device, as claimed in claims 1, characterized in that the flaps (1' to 12') are prestressed by a spring element in the direction of the closed state.

14. Actuating device, as claimed in claims 1, characterized in that the door (30) can be held in the closed position by a locking mechanism.

15. Actuating device, as claimed in any claims 1, characterized in that the housing (32) and/or the door (30) are made of an insulating material.

16. Actuating device, as claimed in claims 1, characterized in that the door (30) is made of an insulating glass material.

17. Actuating device, as claimed in claims 1, characterized by a cooling unit for cooling the space enclosed by the housing (32) and the door (30).

* * * * *